United States Patent [19]

Giuiuzza

[11] 4,165,689

[45] Aug. 28, 1979

[54] DEVICE FOR SEQUENTIAL OVERTURNING OF SHEETS IN MULTI-COLOR OFFSET PRINTING MACHINES

[75] Inventor: Pietro Giuiuzza, Milan, Italy

[73] Assignee: Officine Meccaniche Cigardi S.p.A., Milan, Italy

[21] Appl. No.: 851,645

[22] Filed: Nov. 15, 1977

Related U.S. Application Data

[63] Continuation of Ser. No. 707,796, Jul. 22, 1976, abandoned.

[30] Foreign Application Priority Data

Jul. 24, 1975 [IT] Italy ..... 25698 A/75

[51] Int. Cl.[2] ..... B41F 5/02; B41L 15/10

[52] U.S. Cl. ..... 101/230; 101/232

[58] Field of Search ..... 101/230, 231, 232; 271/197, 82, 225

[56] References Cited

U.S. PATENT DOCUMENTS

| | | | |
|---|---|---|---|
| 214,065 | 4/1879 | Tucker | 101/230 X |
| 1,949,001 | 2/1934 | Albrecht | 101/230 X |
| 2,896,535 | 7/1959 | Schunemann | 101/230 X |
| 3,648,605 | 3/1972 | Hottendorf | 271/197 X |
| 3,772,990 | 11/1973 | Weisgerber | 101/230 |
| 3,884,146 | 5/1975 | Ruetschle | 101/230 |
| 3,963,235 | 6/1976 | Snellman et al. | 271/197 |

FOREIGN PATENT DOCUMENTS

| | | | |
|---|---|---|---|
| 2110962 | 9/1971 | Fed. Rep. of Germany | 101/230 |

*Primary Examiner*—J. Reed Fisher

*Attorney, Agent, or Firm*—William Anthony Drucker

[57] ABSTRACT

A device to be associated to a transfer means, generally a transfer cylinder, of an offset type printing machine including more than two units interconnected in series by said transfer means, the device performing the overturning of sheets for printing the sheet on both faces thereof, said device being completely external of said transfer means and including an auxiliary overturning cylinder provided with gripper means for fully detaching and winding thereabout sheets from said transfer cylinder, and a reversal and progressing mechanism adapted to engage the formerly trailing edge of the sheet wound about said cylinder and to said sheet, in the direction opposite to that in which it has been wound, to the or to one of the transfer means for positioning the other face of the sheet for printing thereon in the downstream unit or units.

1 Claim, 9 Drawing Figures

Fig. 1
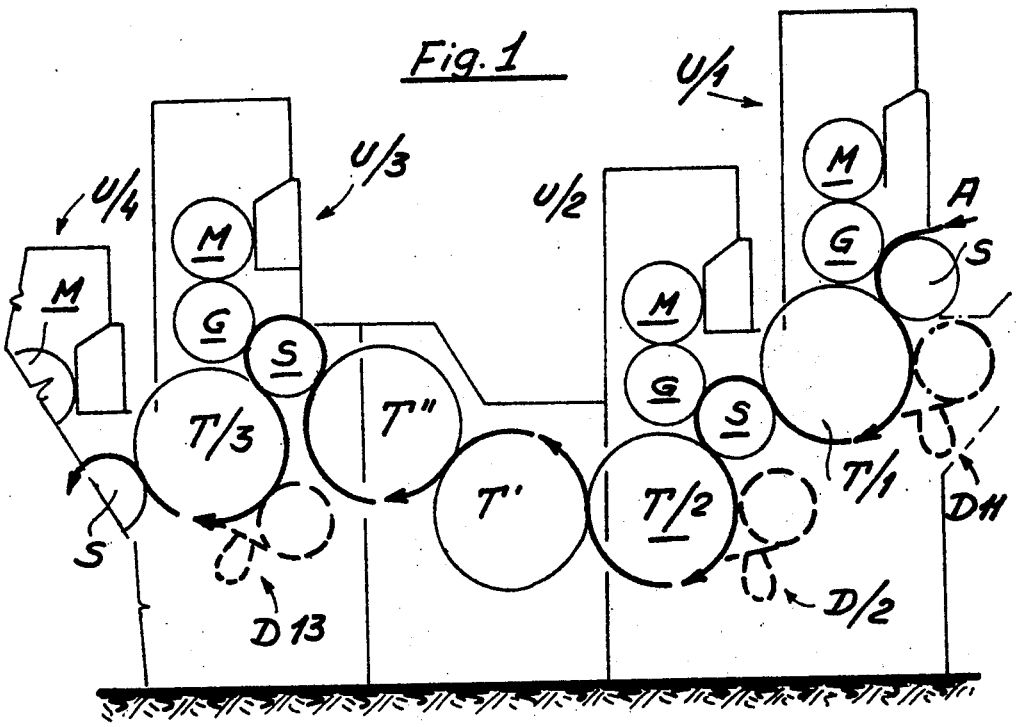
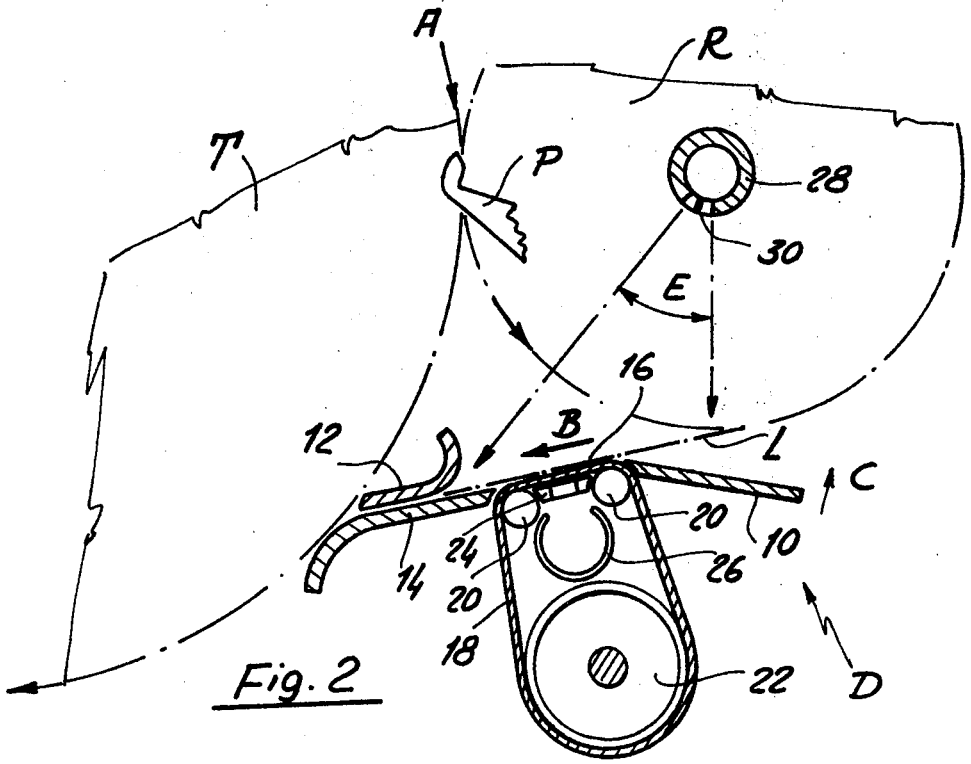
Fig. 2

Fig. 3
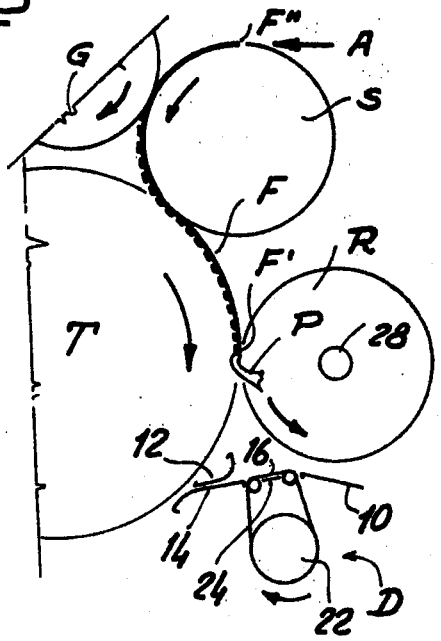
Fig. 4
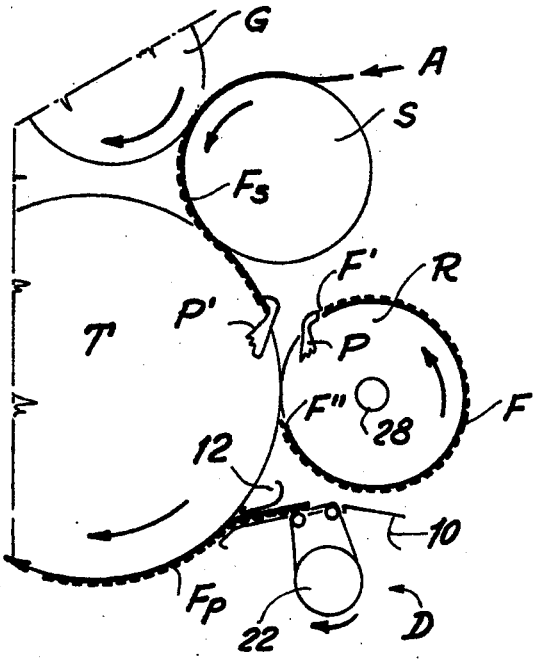
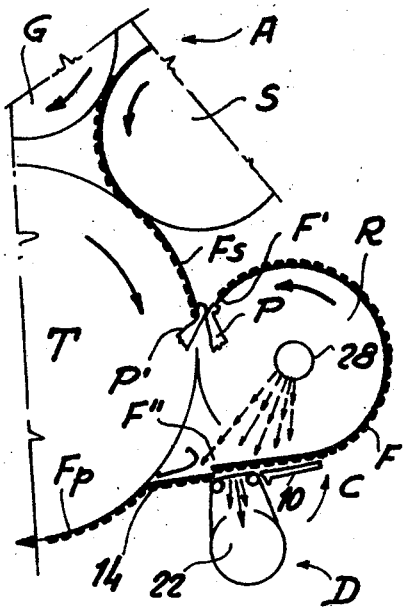
Fig. 5
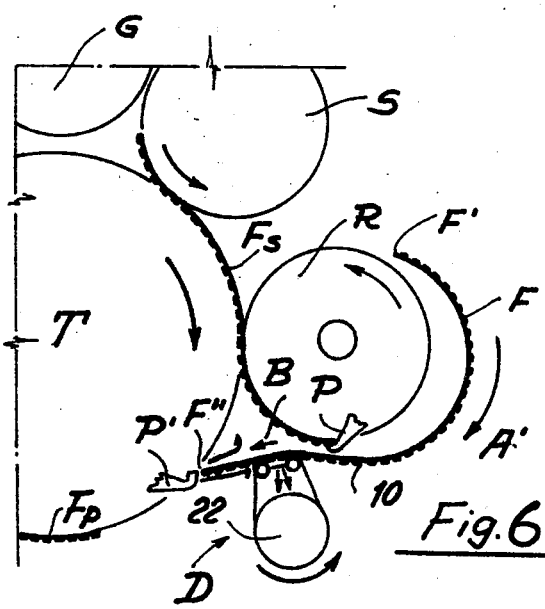
Fig. 6

DEVICE FOR SEQUENTIAL OVERTURNING OF SHEETS IN MULTI-COLOR OFFSET PRINTING MACHINES

This application is a continuation of my application Ser. No. 707796 filed 22 July 1976, now abandoned.

BACKGROUND OF THE INVENTION (a) The Field of the Invention

This invention relates to the art of overturning the sheets fed successively and printed on offset printing machines, namely for carrying out so called "white and perfecting" printing for obtaining, in a multi-colour printing machine including a plurality of printing units arranged and operating in series (independently of the division of these units into either individual or multiple structural groups) the impression or printing of the sheet on both faces in one or more colours, the sum of the colours printable on the two faces obviously not exceeding the number of the printing units of the machine.

(b) The Prior Art

Offset printing machines are well known and no further comments thereon are necessary, except the following, for the purpose of a better understanding of the present invention. In these machines, every printing or operating unit includes a series of counter-rotating cylinders, such as a plate cylinder effecting impressions on the surface of a rubber cylinder, which in turn conveys the impression onto a sheet wound on a printing cylinder. In said multi-colour sheet printing machines, the subsequent printing units, each provided with said series of cylinders, are interconnected by cylinders or chains or equivalent rotating or circuiting "transfer" means (which will therefore be termed, in the following specification and claims "transfer means" even if they will be described as consisting of transfer cylinders). These means transfer, under conditions of synchronism and phased timing, the successive sheets from a printing unit to a downstream printing unit.

Said units obviously also comprise structural components, and means for driving, wetting, inking, feeding, discharge and so on, not relevant to the invention.

The passage of the sheets from the printing cylinders to the transfer means and conversely, all counter-rotating at identical tangential speed, is performed by controlled grippers associated with check-dowels, and actuated so that the grippers of the component releasing the sheet (printing or transfer) bring the front edge thereof to a position tangentially adjacent to the component receiving it (transfer and printing) and release such edge whilst the grippers of the receiving component then engage it. All the sheets run through the entire machine, effecting curved movements in an alternately opposite directions. In these multi-colour printing machines, effecting multi-colour printing on the same face of the sheets, this impression or printing is received on the "convex" face of the sheet during its passage around the former and all subsequent printing cylinders.

In order to provide printing on both faces of the sheets, there are used printing machines, provided with a so called "white perfecting device", imposing on the sheet (and obviously on all subsequently fed sheets) a more intricate path. This white perfecting device is such as to cause the "concave face" of the sheet, during its passage around the upstream printing cylinders, to become the "convex face" of sheet. Generally speaking, the said white perfecting devices are internal to a transfer cylinder and involve considerable difficulties in construction, mounting, adjustment and service of the machine, whilst imposing on the sheets a most intricate path of travel.

SUMMARY OF THE INVENTION

With the foregoing in mind, it is the object of this invention to provide a "white and perfecting" system and devices, associated or associable with multi-colour offset printing machines which could well be conventional under any other aspect, provided they are arranged and adapted to the purpose, this association taking place in at least one and preferably in a plurality of locations, the number of which may be comprised between unity and "n−1", in which "n" stands for the number of printing units. The said white perfecting devices are external to one or more transfer means and can be readily and individually actuated or non-actuated for selecting as desired the position, along the travel of the sheet itself, of the point whereat the sheets are overturned by the device or by one of these "white and perfecting" devices.

With this advantage there is associated that of the possibility of an immediate restoration of the machine to its original multi-colour printing service on a single face of the sheet by means, and along a path of travel, identical to that of the conventional printing machines, by simply taking out of service the aforesaid white and perfecting device or devices provided in the machine.

The device or the devices (in the case of an at least 3-colour printing machine) assording to the present invention are further particularly accessible, of simple and safe performance, and are also applicable to pre-existing multi-colour offset printing machines, provided that in the structure thereof there is already an adequate space available adjacent the transfer cylinders or other transfer means.

These and other features of the invention will become apparent from the following detailed description of preferred embodiments thereof, read in conjunction with the accompanying drawings.

SHORT DESCRIPTION OF THE DRAWINGS

In the drawings:

FIG. 1 is a vertical longitudinal section of an at least 4-colour offset printing machine. Further printing units could be hypothetically present at the left hand end, in these drawings, of the schematically designed machine. The machine includes the same number of devices according to the present invention, each device being associated with a tranfer cylinder downstream of each printing cylinder (excepting the last one) for demonstration by way of example of the possibilities of obtaining the maximum flexibility of service in the selection of the colour or colours to be impressed on one and the other face of the sheets;

FIG. 2 shows similarly on an enlarged scale and in detail one of the devices of this invention, and FIGS. 3, 4, 5 and 6 represent on a smaller scale diagrammatically, the operation of the device (and in a closely analogous manner of any further device associated with the machine);

DETAILED DESCRIPTION OF THE PREFERRED EMBODIMENTS

Figure 7:
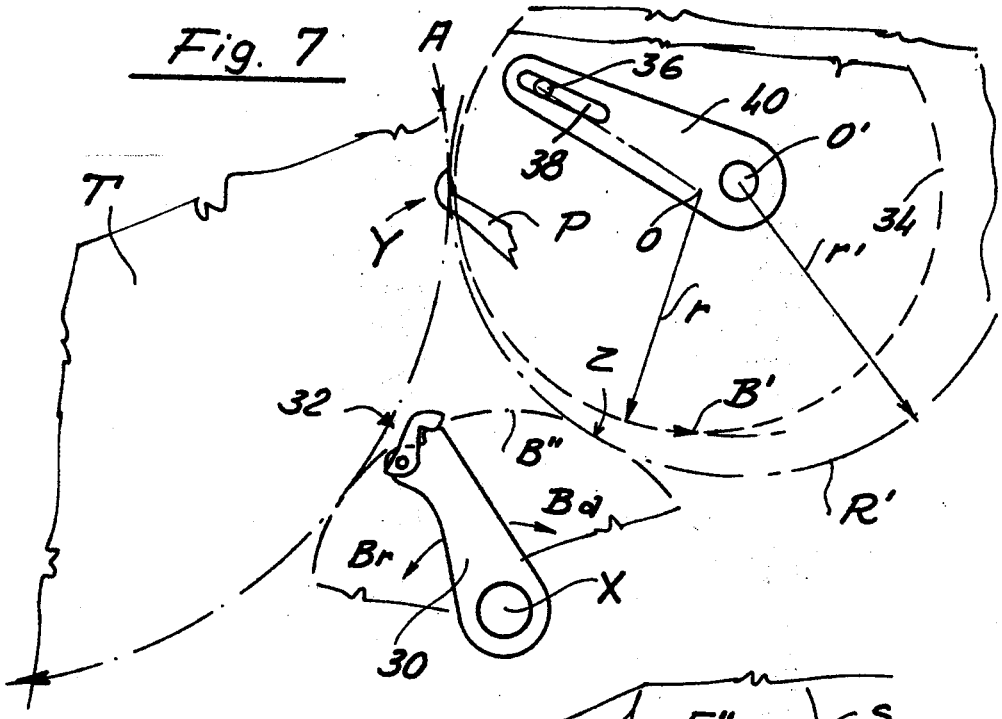
FIG. 7 illustrates a modified embodiment of the device of FIG. 2.

In the embodiment shown in FIG. 1, the printing machine includes a plurality of operating units U (for example associated in structural groups of two units) each including, according to well known art, one plate cylinder M, one rubber cylinder G and one printing cylinder S, the former unit being fed by a conventional feeder (not shown) and the latter unit being followed by a conventional collecting and stacking system for the printed sheets (said system being likewise not shown in the drawings).

Immediately downstream of each printing cylinder there is located at least one transfer cylinder T, transferring directly, or through other complementary transfer cylinders T' and T'', the sheet printed by any subsequent printing unit.

In FIG. 1 the printing units are designated U/1–U/4 (and similarly some of the cylinders) to indicate the sequence thereof, whereas in FIGS. 2–6 this complementary numeral designation is omitted, because the disclosure and the discussion herein of the device shown are valid for each of the units in which said device may be associated.

In FIG. 1 there is shown lines of greater thickness the path of the sheets, fed in the direction A through the machine and winding sequentially about arcs of the subsequent printing and transfer cylinders, and going foward in the direction indicated by the arrows.

As shown in FIG. 1, the machine operates so as to carry out conventional multi-colour printing (in the maximum number of colours compatible with that of the units U) on a single face of the sheet. The transfer between one and other of the said cylinders is carried out in known manner by means of a known system of grippers (not shown). Consequently, under these conditions, the machine corresponds to a multi-colour offset printing machine of conventional tye.

According to the present invention, the machine includes at least one "white and perfecting device" which will be hereunder described and is generally indicated at D. In the embodiment exemplified in FIG. 1, the machine includes as many devices D/1–D/3 as there are transfer cylinders T/1–T/3 located downstream of each printing cylinder, excepting, obviously, the last one.

Consequently, on the assumption that the machine is a 4-colour printing machine, the selection of the overturning of the sheet along its path may be variable. For example, a sheet printed in one colour in the first unit U/1 may be overturned by activating the device D/1, then transferred to the subsequent unit U/2, to be then printed in three colours in the units U/2–U/4. Similarly, by activating the device D/2, the sheet may be printed in two colours on each of its faces in the units U/1 and U/2 and in the units U/3 and U/4, respectively.

Finally, by activating the device D/3, the sheet printed in three colours in the units U/1–U/3 on a first face may receive a monochrome impression on its opposite face in the unit U/4.

Obviously, by having further units U and devices D available, the flexibility of the colours selection may be still greater. On the other hand, the possibility is not excluded of using two more devices D, for example in the case of having to proceed urgently with the printing of sheets in colours on its two faces, not sequentially corresponding to the colours with which the different units are inked, provision can be made for completing the printing of one face after having already effected a first reversal. The activation and the disactivation of the devices according to the present invention may be effected simply by connecting and disconnecting their rotary components, by means of clutch means well known in the art, even without discontinuing the operation of the machine.

Each of the devices according to one embodiment of the present invention is arranged substantially as shown in FIG. 2. It is associated with a transfer cylinder T, by placing an auxiliary counter-rotating overturning cylinder R in tangential cooperation and synchronism and phase condition with the associated transfer cylinder. This overturning cylinder R includes a known gripper system P operated, positioned and so as to transfer about the said overturning cylinder R the sheet coming in the direction A about the coupled transfer cylinder T, in the manner hereunder described. The device comprises further a sliding, dragging and introducing system bringing the sheets received about said overturning cylinder R in the opposite direction B, along an approximately tangential path as diagrammatically indicated by the dash-and-dot line L in FIG. 2. This system includes, proceeding in the direction B, an entrance support table 10, mounted for oscillation in the direction C and movable by mechanical means or hydraulic-pneumatic cylinders (not shown) between the lowered position illustrated in FIG. 2 and the raised position adjacent and close to the line L (and shown in FIG. 5), and a guide exit support, formed by two overlapping components 12 and 14 for guidedly progressing the overturned sheet (as will be described hereunder) to the transfer cylinder T. Between the said components 10 and 14 there are located upper legs 16, co-planar with said guide 12, 14 of perforated belts 18 supported by guide rollers or pulleys 20 and driven by a roller or a set pulleys 22, said legs 16 sliding along above a perforated table 24 under which there is disposed the opening of a suction system 26. The overturning cylinder R is supported and driven (when the device D is actuated) so as to rotate, in a direction complying with the feeding direction of the sheets, about a hollow shaft 28 inside which pressurized air can be fed, and provided with openings 30 arranged and directed to eject an air jet having an angular amplitude E so as to strike a surface containing the said line L for the purposes which will be described later herein.

When actuate and suitably controlled, the device D operates as hereunder described with reference to FIGS. 3 to 6: Assuming that a sheet F progressing in direction A, has received an impression following its contact with the rubber cylinder G, it is further forwarded about the subsequent transfer cylinder T (the face of the sheet F which has received the impression is identified by a series of dashes adjacent the line indicating the section of said sheet F). In FIGS. 3 to 5 the direction of the different cylinders is indicated by respective arrows.

When the leading edge F' of the sheet reaches the position of transfer to the overturning cylinder R, it is released by the grippers P' of the transfer cylinder I and is engaged by the grippers P of the overturning cylinder R as shown in FIG. 3.

This overturning cylinder R is of such a diameter as to receive on its surface with room to spare, all the length of the sheet F so that, by the effect of the sheet rotation it entirely leaves the transfer cylinder T and its trailing edge F'' moves away from the latter transfer cylinder, the end of this phase being illustrated in FIG. 4.

In said FIG. 4, and subsequent FIGS. 5 and 6, there are also diagrammatically depicted the subsequent sheets Fs to be overturned and the upstream sheet Fp which has been overturned and proceeds along its path, the latter sheet not being shown in FIG. 3 in order better to illustrate the initial phase.

At the end of this phase, and as may be observed in FIG. 5, a jet of pressurized air is ejected from the hollow stationary shaft 28 and a diverging air stream, designated by a series of small arrows, is projected on the now leading portion of the sheet, and the table 10 is raised in direction C and the gripper P free the now trailing edge F' of the sheet. This takes place while the previous sheet Fp is about to leave the space overlying the upper legs 16 of the belts, maintained in stretched condition by the rearward motion of the latter, this condition being easier seen in FIG. 4.

The air jet throws the rear portion of the sheet onto the surface defined by the table 10 which has been raised, or by the back portion of the upper legs 16 of the belts, whereas the motion of the latter is reversed and takes on the direction B (this belt being actuated by suitable mechanisms, for example cam mechanisms, not shown in the drawings, imposing on the pulleys rotary reciprocating motions in synchronism with the motion of the cylinders T and R). The dropping down of said portion of the sheet F is represented in FIG. 5.

As shown in FIG. 6, the sheet F, after getting detached from the cylinder R, is dragged by the belts, against which it is kept adherent by the effect of the underlying suction, in the direction A' opposite that of its previous motion so that it edge F'' now becomes its leading edge, and passing between the upper guide 12 and the support 14 (see FIG. 2), moves forward to come into contact again with the transfer cylinder T to be again engaged by the grippers P' of the latter, which had freed the leading edge of the subsequent sheet, now already engaged by the grippers P of the overturning cylinder R, and in the process of winding about the latter.

The sheet F is, therefore, re-inserted into the path of the machine in overturned position, to be subsequently printed on its other face. Obviously, the use of the device of this invention requires an auxiliary control means for providing a short complementary opening and closing sequence of the grippers P' of the transfer cylinder T, which sequence is terminated when the device is no longer actuated.

The grippers P', instead of fulfilling only the function of engaging the leading edge F' of the sheets until transferring them to the grippers of the subsequent printing cylinder S (or auxiliary transfer cylinder T') should open to transfer them to the grippers P of the overturning cylinder R (FIG. 3) and close again about the other edge F'' of the overturned sheet to proceed to complete their transferring into the downstream mechanism.

Figure 8:
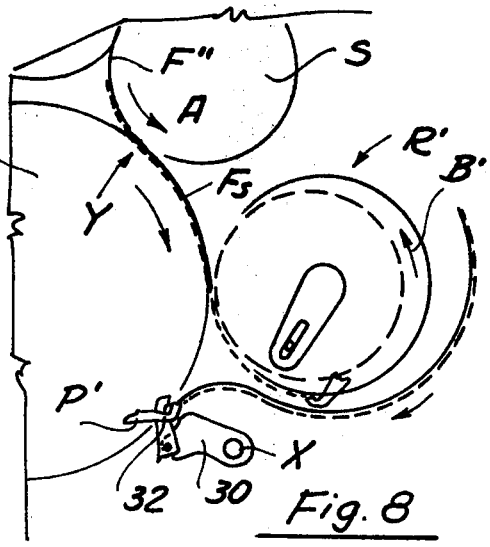
FIG. 8 illustrates, on smaller scale, the device of FIG. 7, of a working phase corresponding to that of FIG. 6.

The device of the invention may obviously be constructed and arranged in different ways. For example, the device may be constructed and operated as illustrated in FIGS. 7 and 8 or, as in FIG. 9. In the embodiment of FIGS. 7 and 8, the overturning cylinder R', provided with grippers P, as above described, has a diameter considerably greater than that of the adjacently upstream printing cylinder S, the grippers being positioned also as above described, for gripping the leading edge portion of the sheet, supplied in the direction A and as released from the grippers P' of the transfer cylinder T.

In this modified embodiment, the rearward motion and the re-feeding of the overturned sheet is provided by an oscillating mechanism including oscillating braces 30 provided with grippers 32. Such oscillating braces are supported for oscillating movement about axis X located at equal distances from the peripheries of auxiliary overturning cylinder R' and of the transfer cylinder T, so that said grippers 32 are caused to oscillate, alternatively in directions Ba and Br, upon phased actuation (by conventional actuators, not shown) along an arc B'' having its center at X and tangential to both said peripheries.

The leading edge of each sheet, printed on only one of its faces and supplied in the direction A, is transferred from the transfer cylinder T to the auxiliary cylinder R' at location Y and it is progressed about said auxiliary cylinder R' until its trailing edge attain the second location at Z where said trailing edge can be gripped by the grippers 32 of the braces 30, fully oscillated in direction Ba for being pulled in the reverse direction and reapplied about the transfer cylinder T, the trailing edge becoming now the leading edge of the overturned sheet, by the reversed motion, in direction Br, of the braces 30.

For taking into account the fact that the sheet being overturned must travel about the overturning auxiliary cylinder R' for a distance at least equal to the length of said sheet plus the distance between Y and Z, to prevent interference with another sheet which follows, said auxiliary cylinder R' has a radius r' and is supported and driven for rotation about a axis 0' spaced from the axis 0 as though the cylinder R' had a diameter equal to that of the printing cylinder S (FIG. 8).

It is known to those skilled in the art that for proper timing and phase relationship the adjacent cylinders of printing units should be driven and interconnected by gearing means including intermeshing gears of equal rolling pitch diameters, that is with an equal number of teeth. According to a feature of the invention, therefore, said auxiliary cylinder R' is driven by a gear the pitch line of which is diagrammatically indicated by the circle 34, shown in broken line, of radius r and having its center at 0. A driving pin 36 is secured to said gear and is slidingly engaged into and can move along a nearly radially arranged slot 38 provided in an arm 40 keyed or otherwise connected for rotation to said auxiliary cylinder R'.

From FIG. 7, it can be seen that centers 0 and 0' are aligned with the location Y where the sheets are transferred from the transfer cylinder T to the auxiliary cylinder R'. At said location Y, therefore, the grippers P of auxiliary cylinder R' travel at the same peripheral speed that of the grippers of the transfer cylinder (see the gripper P' of FIGS. 4 and 5) for ensuring proper transfer. The auxiliary cylinder R' will then be accelerated (by the action of mechanism 36–40) for carrying the trailing edge of the sheet at location Z, and the grippers will open to release such sheet before again reaching, while decelerating, the location Y for gripping another subsequently supplied sheet.

Figure 9:
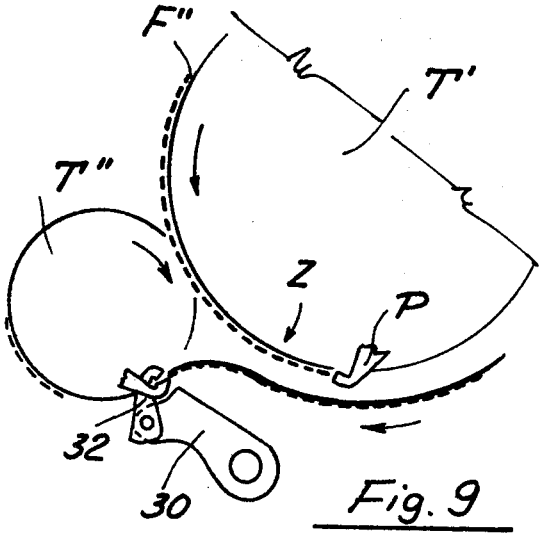
FIG. 9 illustrates another modified embodiment of the device.

In the event that the printing machine is provided (as a number of currently manufactured machines are) with three transfer cylinders between two printing cylinders (this is the arrangement of the transfer system between units U/2 and U/3 in the machine of FIG. 1, for example) and wherein one transfer cylinder is of diameter exactly two or (more commonly) three times that of the adjacent downstream cylinder as the cylinders T′ and T″ of FIG. 9), the reversing mechanism of FIGS. 7 and 8 can be more simply arranged as shown in FIG. 9. The large peripheral dimension of the upstream cylinder ensuring ample space for the double transfer in the supply and in the reversed directions, without interference with the subsequently supplied sheet.

The reversing device of FIGS. 7 to 9 can be differently constructed. For example, the grippers 32 can be replaced by suction means (well known in the art of printing machines) supported and phasedly actuated at the outer ends of braces or levers 30 or other means. The term "gripper means" will therefore encompass also such equivalent suction means.

I claim:

1. A device, for the sequential overturning of printed sheets in a multi-color offset printing machine including at least two printing units each having a known assembly of plate, rubber and printing cylinders, said printing units being interconnected by at least one means for transferring a printed sheet from one printing unit to another printing unit, said device being positioned externally of and associated with said transfer means, said device comprising:

(i) an auxiliary overturning cylinder (R′) positioned adjacent to said transfer means (T) said auxiliary overturning cylinder being of a diameter which is larger than the diameter of the printing cylinder (S) next upstream thereof, (ii) means (P) for engaging a leading edge of a printed sheet carried on said transfer means (T) and for temporarily holding said leading edge on said auxiliary overturning cylinder (R′) until said printed sheet has become fully detached from said transfer means (T) and has become wholly carried on said auxiliary overturning cylinder (R′)

(iii) means (30,32) for detaching said printed sheet from said auxiliary overturning cylinder (R′) and for carrying said sheet along a path which meets the contour of said transfer means (T) at a second point downstream of the point (Y) of detachment of the sheet from said transfer means (iv) means for driving said auxiliary overturning cylinder (R′) through an angular stroke such that its peripheral movement is at least equal to the arc defined on the contour of the transfer means (T) between said point of detachment and said second point, said driving means comprising:

(a) a member (34) rotatable oppositely to and at a speed of rotation constant relative to the speed of rotation of the transfer means (T) about an axis (O) parallel to the axis (O′) of the auxiliary overturning cylinder and situated between said point of detachment (Y) and the axis (O′) of the auxiliary overturning cylinder (b) means (36,38,40) coupling said rotatable member and said auxiliary overturning cylinder for roration.

* * * * *